US012366433B2

(12) United States Patent
Wimmer et al.

(10) Patent No.: US 12,366,433 B2
(45) Date of Patent: Jul. 22, 2025

(54) DRIVER'S CAB AND UTILITY VEHICLE

(71) Applicant: Rheinmetall MAN Military Vehicles Österreich GesmbH, Vienna (AT)

(72) Inventors: Robert Wimmer, Möllersdorf (AT); Andras Fejes, Györ (HU)

( * ) Notice: Subject to any disclaimer, the term of this patent is extended or adjusted under 35 U.S.C. 154(b) by 321 days.

(21) Appl. No.: 17/906,533

(22) PCT Filed: Feb. 19, 2021

(86) PCT No.: PCT/EP2021/054157
§ 371 (c)(1),
(2) Date: Sep. 16, 2022

(87) PCT Pub. No.: WO2021/185527
PCT Pub. Date: Sep. 23, 2021

(65) Prior Publication Data

US 2023/0134113 A1 May 4, 2023

(30) Foreign Application Priority Data

Mar. 19, 2020 (DE) ..... 10 2020 107 664.9

(51) Int. Cl.
*F41H 7/04* (2006.01)

(52) U.S. Cl.
CPC ..... *F41H 7/042* (2013.01)

(58) Field of Classification Search
CPC ..... F41H 7/042; F41H 7/044; B62D 21/152; B62D 25/2018; B62D 21/155;
(Continued)

(56) References Cited

U.S. PATENT DOCUMENTS 7,458,632 B2 * 12/2008 Yamada ..... B62D 29/008 296/193.07
8,943,946 B1 * 2/2015 Richmond ..... B62D 21/15 89/36.02

(Continued)

FOREIGN PATENT DOCUMENTS

DE 102012001117 A1 7/2013
DE 102013101625 A1 8/2014

(Continued)

OTHER PUBLICATIONS

IP Australia, Office Action Issued in Application No. 2021238417, Sep. 27, 2023, 3 pages.

(Continued)

*Primary Examiner* — Lori Lyjak
(74) *Attorney, Agent, or Firm* — Alleman Hall & Tuttle LLP

(57) ABSTRACT

Driver's cab for a utility vehicle, comprising an interior space enclosed by the driver's cab, a driver's cab floor, and a protrusion formed on the driver's cab floor, wherein the protrusion is curved away from the interior space, wherein the protrusion comprises a first contour defining the protrusion in a first sectional plane intersecting the driver's cab floor, wherein the first contour is curved in an arcuate manner at least in sections, wherein the protrusion comprises a second contour defining the protrusion in a second sectional plane intersecting the driver's cab floor, wherein the second contour is curved in an arcuate manner at least in sections, and wherein the first sectional plane and the second sectional plane are positioned perpendicular to each other.

13 Claims, 5 Drawing Sheets

(58) Field of Classification Search
CPC .... B62D 25/20; B62D 25/2072; B62D 33/06; B62D 33/0604; B60R 21/12
USPC ..... 89/36.09; 296/187.01, 187.07, 187.08, 296/190.01, 190.03, 190.07, 193.07
See application file for complete search history.

(56) References Cited

U.S. PATENT DOCUMENTS

2004/0232731 A1* 11/2004 Corcoran ..... B21D 26/033 296/205
2008/0238152 A1* 10/2008 Konishi ..... B60N 2/012 296/204
2010/0170388 A1* 7/2010 North ..... F41H 7/02 89/36.08
2011/0168001 A1* 7/2011 Lee ..... F41H 7/04 89/917
2011/0314999 A1* 12/2011 Luther ..... F41H 7/044 89/36.02
2012/0097019 A1* 4/2012 Sherbeck ..... F41H 7/044 89/36.02
2012/0174767 A1 7/2012 Naroditsky et al.
2013/0014635 A1* 1/2013 Kosheleff ..... F41H 7/042 89/36.02
2013/0249244 A1* 9/2013 Cassaday ..... F41H 7/042 296/187.03
2014/0026741 A1* 1/2014 Dunne, Jr. ..... F41H 7/042 89/36.02
2014/0150633 A1* 6/2014 Mears ..... F41H 5/013 89/36.02
2023/0358512 A1* 11/2023 Klise ..... F41H 7/048

FOREIGN PATENT DOCUMENTS

JP H1134933 A 2/1999
JP 2012183858 A 9/2012
WO 2013114894 A1 8/2013
WO 2013115894 A2 8/2013
WO 2019209763 A1 10/2019

OTHER PUBLICATIONS

Canadian Intellectual Property Office, Office Action Issued in Application No. 3169759, Nov. 2, 2023, 4 pages.
Saudi Authority for Intellectual Property, Office action issued in Saudi Arabian Application No. 522440552, Mar. 31, 2023, 6 pages. (Submitted with English Summary of OA as Explanation of Relevance).
Kuwait Patent Office, Office Action Issued in Application No. KW/P/2022/001338, Jun. 3, 2024, 4 pages.
Ukrainian National Office for Intellectual Property and Innovations, Office Action Issued in Application No. 2022 03712, Jun. 12, 2024, 10 pages.
United Arab Emirates Ministry of Economy, Search Report and Written Opinion Issued in Application No. P6001902/2022, Oct. 6, 2024, 9 pages.

* cited by examiner

DRIVER'S CAB AND UTILITY VEHICLE

FIELD

The present invention relates to a driver's cab for a utility vehicle, in particular for a military utility vehicle, and to a utility vehicle, in particular a military utility vehicle, comprising such a driver's cab.

BACKGROUND

Off-road utility vehicles for military use usually have a protected driver's cab. In order to protect the occupants of the driver's cab against shelling, booby traps, improvised explosive or incendiary devices (IEDs), mines or the like, the driver's cab has a correspondingly armored driver's cab floor. The applicant is aware of in-house prior art in which additional material is provided on the driver's cab floor in the form of thickenings, such as several plates welded together, ribs and/or stiffening elements. This makes it possible to produce a driver's cab floor that is as stiff as possible and can withstand a shock wave generated during an impact on the driver's cab and does not deform into the driver's cab.

SUMMARY

Against this background, one object of the present invention is to provide an improved driver's cab for a utility vehicle.

Accordingly, a driver's cab for a utility vehicle, in particular for a military utility vehicle, is provided. The driver's cab comprises an interior space enclosed by the driver's cab, a driver's cab floor, and a protrusion formed on the driver's cab floor, wherein the protrusion is curved away from the interior space. The protrusion comprises a first contour defining the protrusion in a first sectional plane intersecting the driver's cab floor, wherein the first contour is curved in an arcuate manner at least in sections, wherein the protrusion comprises a second contour defining the protrusion in a second sectional plane intersecting the driver's cab floor, wherein the second contour is curved in an arcuate manner at least in sections, and wherein the first sectional plane and the second sectional plane are positioned perpendicular to each other.

The fact that the protrusion curved away from the interior space is provided on the driver's cab floor means that a high structural strength or rigidity of the driver's cab floor can be achieved due to the three-dimensional geometry of the protrusion defined by the two contours. Advantageously, the additional materials mentioned at the outset can be dispensed with. This results in a weight reduction, the machining effort is reduced and deteriorating material properties due to heat input during welding of the additional materials can be prevented.

The driver's cab can also be referred to as the operator's cab or driver's cabin. The driver's cab is suitable for accommodating several occupants, for example a driver and a co-driver. In particular, the driver's cab is or may be referred to as a protected driver's cab. That is, the driver's cab is protected against shelling, booby traps, IEDs, mines, or the like. For this purpose, the driver's cab may be constructed of armored steel plates, for example, or may comprise armored steel plates. However, aluminum alloys or fiber composites can also be used.

The driver's cab comprises a front wall, a rear wall arranged opposite the front wall, two opposing side walls and the driver's cab floor. A ceiling of the driver's cab is placed opposite the driver's cab floor. A windshield may be attached to the front wall. Doors may be provided on the side walls. The front wall, the rear wall, the side walls, the ceiling and the driver's cab floor enclose the interior space and thus delimit the interior space from an environment of the driver's cab. The interior space can be accessible from the environment via doors and/or hatches. The sectional planes can be assigned to the driver's cab and/or the driver's cab floor.

In the present context, a "protrusion" is to be understood as a three-dimensional geometry which is bulge-shaped or at least sectionally spherical, egg-shaped or similarly curved. The protrusion can also be referred to as dent or bulge. The protrusion has the shape of a free-form surface, for example. In the present case, the fact that the protrusion is "curved away" from the interior space means that the protrusion extends away from the interior space and extends into the environment of the driver's cab.

A "contour" in this context means in particular a curve which, when viewed perpendicularly to the respective sectional plane, delimits the protrusion from its environment for an observer. The term "contour" can be replaced by the terms "outline" or "curve". In particular, the contours may each be composed of different radii, ellipse sections, oval sections, curve sections, straight line sections or the like. However, in each case, the contours are curved in an arcuate manner at least in sections or exhibit an arcuate curvature. In the present context, "curvature" is to be understood as the local deviation of the respective contour from a straight line. The contours can be inner contours or outer contours of the protrusion.

The fact that the contours "define" the protrusion in the respective sectional plane means in particular that the respective contour specifies a two-dimensional geometry of the protrusion, which results in the respective sectional plane when the respective sectional plane intersects the protrusion. In particular, the two contours define or determine the three-dimensional geometry of the protrusion. Preferably, any number of further first sectional planes arranged parallel to the first sectional plane is provided, whereby the first contour changes in the different first sectional planes. The same applies to the second sectional plane and the second contour. The superposition of the two contours results in the three-dimensional geometry of the protrusion. In the case where the contours are identical, the protrusion may in the simplest case be sectionally spherical or spherical calotte-shaped. Preferably, however, the contours differ from each other in their two-dimensional geometry. That is, the first contour and the second contour preferably differ from each other and, in particular, are not identical.

According to an embodiment, a height direction of the driver's cab and a longitudinal direction of the driver's cab span the first sectional plane, wherein the height direction and a cross direction of the driver's cab span the second sectional plane, and wherein the height direction, the longitudinal direction, and the cross direction are positioned perpendicular to each other.

The driver's cab is thus assigned a coordinate system with an x-direction or longitudinal direction, a y-direction or height direction and a z-direction or cross direction. The coordinate system can also be assigned to the driver's cab floor. In the present context, the fact that the height direction and the longitudinal direction "span" the first sectional plane means that the height direction and the longitudinal direction lie in the first sectional plane. Alternatively, the height direction and the longitudinal direction can also only be aligned parallel to the first sectional plane. The same applies to the second sectional plane and correspondingly to the height direction and the cross direction.

According to another embodiment, the first sectional plane and the second sectional plane each intersect the protrusion centrally.

The protrusion may be of mirror symmetrical construction with respect to at least one of the sectional planes. However, as previously mentioned, any number of first sectional planes and/or any number of second sectional planes may be provided, with the first sectional planes and the second sectional planes each being parallel to each other. In this case, these additional sectional planes do not intersect the protrusion centrally.

According to another embodiment, the driver's cab comprises a seat which is arranged above the protrusion.

Preferably, a first seat or driver's seat and a second seat or passenger seat are provided. In particular, the seat is positioned above the protrusion when viewed in the height direction. Each seat may have such a protrusion associated therewith. However, at least the first seat is associated with such a protrusion. Viewed in the cross direction, the seats are spaced apart from one another. Viewed in the cross direction, the seats are preferably positioned centrally above the protrusions. However, viewed in the cross direction, the seats can also be positioned off-center relative to the respective protrusion.

According to a further embodiment, the first contour is continuously curved and/or the second contour is continuously curved.

In particular, the first contour and/or the second contour has a continuous arcuate curvature. That is, either the first contour or the second contour or both contours may be continuously curved. "Continuously curved" means in the present case that the first contour and/or the second contour has no straight line sections. In the event that the first contour and/or the second contour is continuously curved, the respective contour is preferably exclusively composed of different curved geometries, such as circular sections, arcs, radii, elliptical sections, oval sections and/or curved sections. In the present context, an "arc" may be understood to mean an arc of a circle, i.e., a circular section. The first contour and/or the second contour may also be a circular section, an arc, a radius, an ellipse section, an oval section, or a curve section. In this case, the first contour and/or the second contour is not composed of different geometries.

According to a particularly preferred embodiment, a driver's cab for a utility vehicle, in particular for a military utility vehicle, is accordingly proposed. The driver's cab comprises an interior space enclosed by the driver's cab, a driver's cab floor, and a protrusion formed on the driver's cab floor, wherein the protrusion is curved away from the interior space, wherein the protrusion comprises a first contour defining the protrusion in a first sectional plane intersecting the driver's cab floor, wherein the first contour is continuously curved, wherein the protrusion comprises a second contour defining the protrusion in a second sectional plane intersecting the driver's cab floor, wherein the second contour is continuously curved, and wherein the first sectional plane and the second sectional plane are positioned perpendicular to each other.

According to a further embodiment, the protrusion is at least partially egg-shaped.

The term "egg-shaped" can be replaced by the term "ovoid-shaped". The geometry of the protrusion can therefore also be described as ovoid. As used herein, the terms "egg-shaped" or "ovoid-shaped" refer to a three-dimensional roundish figure that is broadly similar to the profile of a bird's egg. In particular, the egg-shaped geometry can be created by rotating an oval about an axis of symmetry. In contrast to an ellipse, however, the oval has only one axis of symmetry, with respect to which the oval has a mirror symmetrical structure. The egg-shaped geometry of the protrusion results from the two contours oriented perpendicular to each other. However, the protrusion only partially forms an egg-shaped geometry, which protrudes downward from the driver's cab floor into the environment.

According to another embodiment, the first contour differs in curvature from the second contour.

The "curvature" or "degree of curvature" in this context means the deviation of the respective contour from a straight line. The greater the curvature, the tighter or stronger the curvature of the respective contour.

According to another embodiment, the second contour is more curved than the first contour.

The differently curved contours result in the egg-shaped geometry of the protrusion. The contours are preferably both convexly curved. Thus, the protrusion itself is also convexly curved. This means that the protrusion curves out of the interior space into the environment.

According to another embodiment, a first protrusion and a second protrusion are formed on the driver's cab floor, wherein the protrusions are spaced apart from each other.

In particular, the first protrusion and the second protrusion are spaced apart from each other when viewed in the cross direction. As previously mentioned, the driver's cab may have two seats, in which case each seat is associated with such a protrusion. In particular, the first seat or driver's seat has the first protrusion associated therewith. Correspondingly, the second seat or passenger seat has the second protrusion associated with it.

According to another embodiment, a third protrusion is formed on the driver's cab floor, wherein the third protrusion is curved away from the interior space, and wherein the third protrusion is arranged between the first protrusion and the second protrusion.

In particular, the third protrusion is arranged between the first protrusion and the second protrusion when viewed along the cross direction. Preferably, the third protrusion bulges less far out of the interior space than the first protrusion and the second protrusion.

According to a further embodiment, a dome section projecting into the interior space is formed on the driver's cab floor and is arranged between the first protrusion and the second protrusion.

Viewed along the height direction, the dome section is preferably arranged above the third protrusion. The driver's cab floor is preferably mirror-symmetrical in relation to a third sectional plane of the driver's cab running centrally through the dome section. The third sectional plane is thereby positioned parallel to and spaced from the first sectional plane. The dome section can accommodate, for example, a transmission tunnel of the utility vehicle. The dome section is positioned between the first seat and the second seat as viewed along the cross direction. In particular, the dome section is positioned centrally in the driver's cab when viewed along the cross direction.

According to a further embodiment, the dome section comprises a radius defining the dome section in the second sectional plane, which radius is curved in the opposite direction to the second contour.

In particular, two radii are provided, which are placed on both sides of the dome section. Preferably, such a radius is provided in the second sectional plane mirror-symmetrically and on both sides of the dome section, which merges into the respective second contour of the first protrusion and the second protrusion. In this case, the radii preferably have an opposite curvature to the respective second contour of the corresponding protrusion.

According to a further embodiment, the dome section comprises a third contour defining the dome section in a third sectional plane parallel to the first sectional plane and arranged at a distance therefrom, wherein the third contour is curved at in an arcuate manner at least in sections.

The third contour may be composed of different radii, ellipse sections, oval sections, curve sections, straight line sections or the like. However, in any case, the third contour has an arcuate curvature or exhibits an arcuate curvature at least in sections. The third contour merges into a fourth contour of the third protrusion in the third sectional plane. In this case, the fourth contour of the third protrusion is curved in the opposite direction to the third contour of the dome section.

According to a further embodiment, the driver's cab floor comprises a lower part, on which the protrusion is formed, and an upper part connected to the lower part at an interface.

The interface can be a weld seam, for example. Preferably, the lower part and the upper part are hot-formed separately by means of a forming process. For this purpose, for example, a blank, in particular in the form of an armored steel plate, is inserted into a suitable press tool and the lower part and the upper part are hot formed. The two-part nature of the driver's cab floor means that a particularly high degree of forming can be achieved. The lower part and the upper part can then be joined together. Alternatively, the driver's cab floor can also be produced in one piece, so that the lower part and the upper part are joined together integrally, in particular as one piece of material.

According to a further embodiment, the lower part and/or the upper part are each formed integrally, in particular as one piece of material.

"Integrally" or "one-piece" means in the present case that the lower part and the upper part are each formed as one component and are not composed of different components. "One-piece of material" means in the present case that the lower part and/or the upper part are in each case manufactured throughout from the same material. Preferably, both the lower part and the upper part are each made of armored steel. However, other materials, such as aluminum alloys or fiber composites, can also be used for the driver's cab floor.

Furthermore, a utility vehicle, in particular a military utility vehicle, comprising such a driver's cab is provided.

The utility vehicle is preferably a land vehicle, in particular a truck. In particular, the utility vehicle is a military utility vehicle. The utility vehicle may therefore also be referred to as a military utility vehicle. In particular, the utility vehicle is an all-terrain truck. The utility vehicle may be a protected vehicle. The utility vehicle includes a chassis frame having a plurality of axles. That is, the utility vehicle is a multi-axle vehicle, particularly a three-axle vehicle. Preferably, the utility vehicle comprises an all-wheel drive. The utility vehicle may therefore be referred to as all-wheel drive utility vehicle. The utility vehicle may be a wheeled vehicle. Alternatively, the utility vehicle may be a tracked vehicle.

The embodiments and features described for the driver's cab apply accordingly to the proposed utility vehicle, and vice versa.

"One" in the present context is not to be understood as necessarily limiting the number of elements to exactly one; rather, several elements, such as two, three or more, may also be provided. Also any other counting word used herein is not to be understood as limiting to exactly the number of elements mentioned. Rather, numer-ical deviations upwards and downwards are possible, unless otherwise specified.

Further possible implementations of the driver's cab and/or the utility vehicle also include combinations of features or embodiments described previously or below with respect to the embodiment examples that are not explicitly mentioned. In this context, the skilled person will also add individual aspects as improvements or addi-tions to the respective basic form of the driver's cab and/or the utility vehicle.

Further advantageous embodiments and aspects of the driver's cab and/or the utility vehicle are the subject of the subclaims and of the examples of embodiments of the driver's cab and/or the utility vehicle described below. In the following, the driver's cab and/or the utility vehicle are explained in more detail on the basis of preferred embodiments with reference to the accompanying figures.

DETAILED DESCRIPTION

In the figures, identical or functionally identical elements have been given the same reference signs unless otherwise indicated. Concealed components are shown in the figures with dashed lines.

Figure 1:
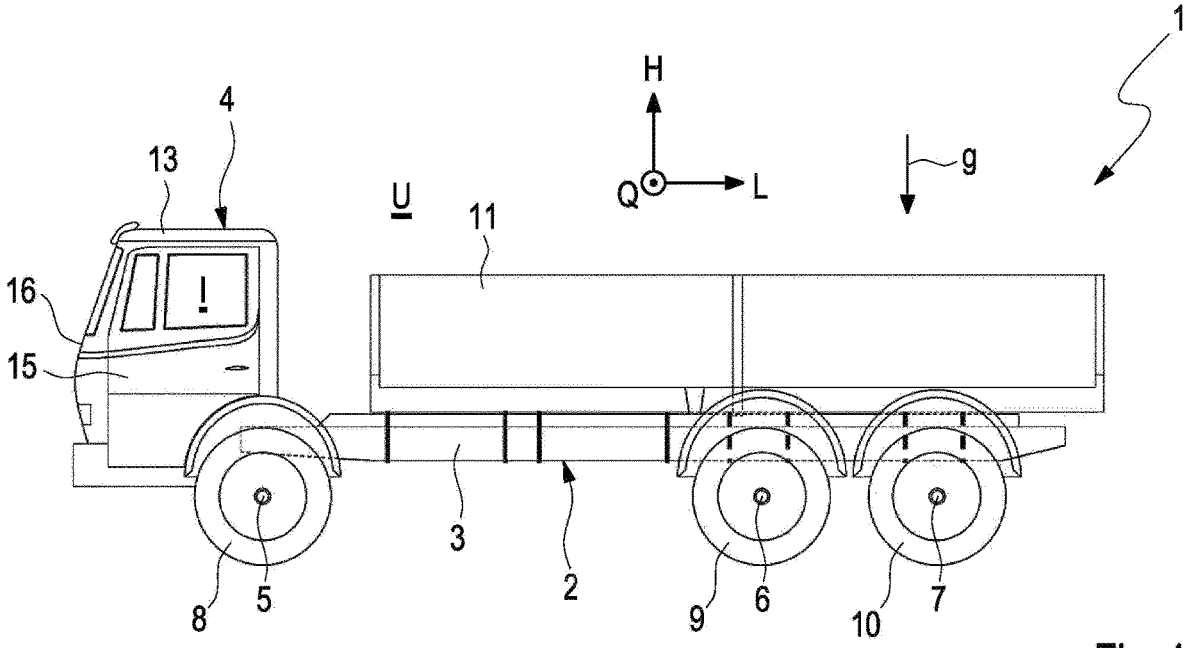
FIG. 1 shows a schematic side view of an embodiment of a utility vehicle.

FIG. 1 shows a schematic side view of an embodiment of a utility vehicle 1. The utility vehicle 1 is a land vehicle. In particular, the utility vehicle 1 is a military utility vehicle. The utility vehicle 1 may therefore also be referred to as a military utility vehicle. As shown in FIG. 1, the utility vehicle 1 may be a truck. In particular, the utility vehicle 1 is an off-road utility vehicle. The utility vehicle 1 may be a protected vehicle.

A coordinate system with an x-direction or longitudinal direction L, a y-direction or height direction H and a z-direction or cross direction Q is assigned to the utility vehicle 1. The directions H, L, Q are oriented perpendicular to each other. The height direction H is oriented parallel to a direction of gravity g. The direction of gravity g is oriented from top to bottom in the orientation of FIG. 1.

The utility vehicle 1 comprises a chassis 2 with a chassis frame 3 extending in the longitudinal direction L. The chassis frame 3 is flexurally rigid and torsionally soft and extends from a driver's cab 4 to a rear of the utility vehicle 1. "Torsionally soft" in this context means in particular that the chassis frame 3 can twist about the longitudinal direction L.

A plurality of axles 5, 6, and 7 are provided on the chassis frame 3. The axles 5, 6, and 7 carry wheels 8, 9, and 10. For example, three axles 5, 6, and 7 may be provided. That is, the utility vehicle 1 in this case is a three-axle vehicle. However, the number of axles 5, 6, and 7 is arbitrary. Preferably, the utility vehicle 1 comprises an all-wheel drive. That is, all axles 5, 6, and 7 are driven. The utility vehicle 1 may therefore also be referred to as an all-wheel drive utility vehicle. The utility vehicle 1 may be a wheeled vehicle, as shown in FIG. 1. Alternatively, the utility vehicle 1 may be a tracked vehicle. The height direction H is oriented from the axles 5, 6, and 7 in the direction of the chassis frame 3.

The chassis 2 is suitable for supporting, in addition to the driver's cab 4, a replaceable and torsionally rigid superstructure 11 of the utility vehicle 1. The superstructure 11 may, for example, be a flatbed, a container, a box, a tank or the like. In FIG. 1, a superstructure 11 in the form of a flatbed is shown.

The driver's cab 4 is preferably protected against bullets, booby traps, improvised explosive or incendiary devices (IEDs), mines or the like. The driver's cab 4 encloses an interior space I in which passengers, for example a driver and a co-driver, can be seated. The driver's cab 4 encloses the interior space I and thus delimits it from an environment U of the driver's cab 4.

Figure 2:
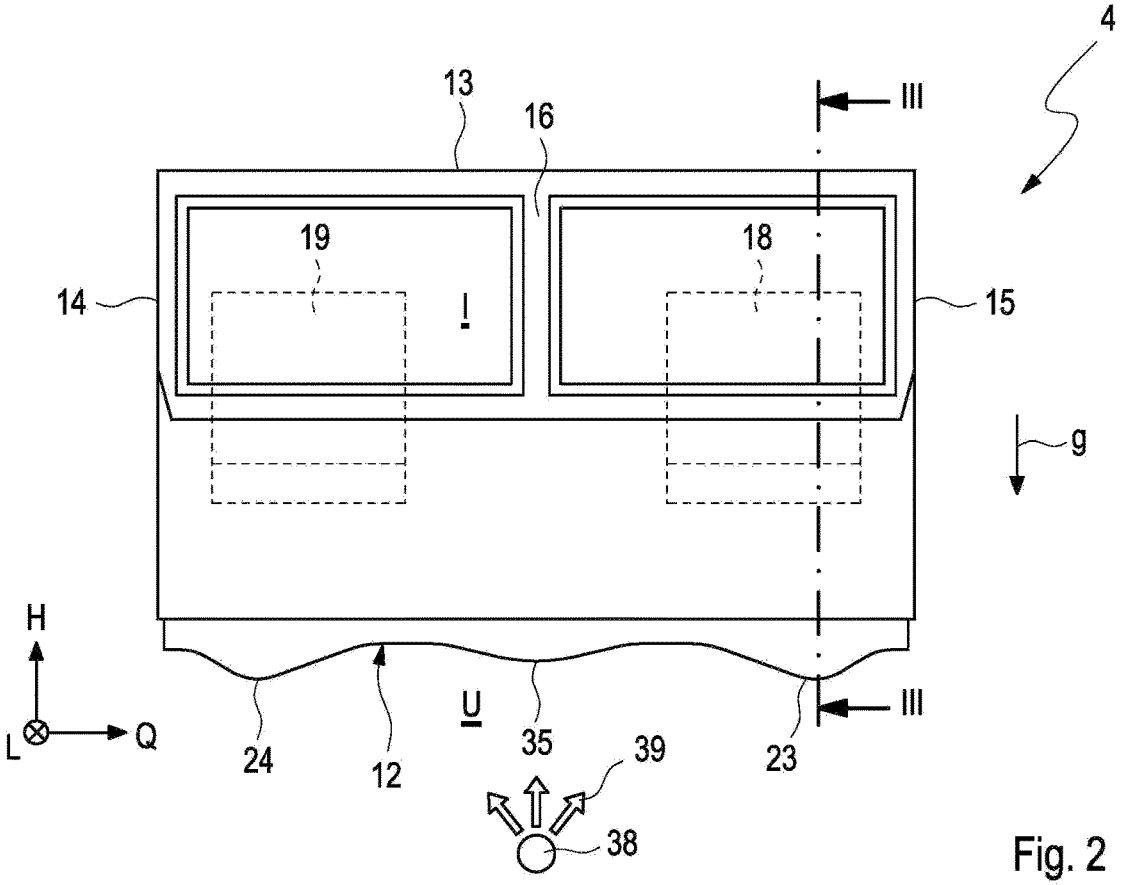
FIG. 2 shows a schematic front view of an embodiment of a driver's cab for the utility vehicle according to FIG. 1.
Figure 3:
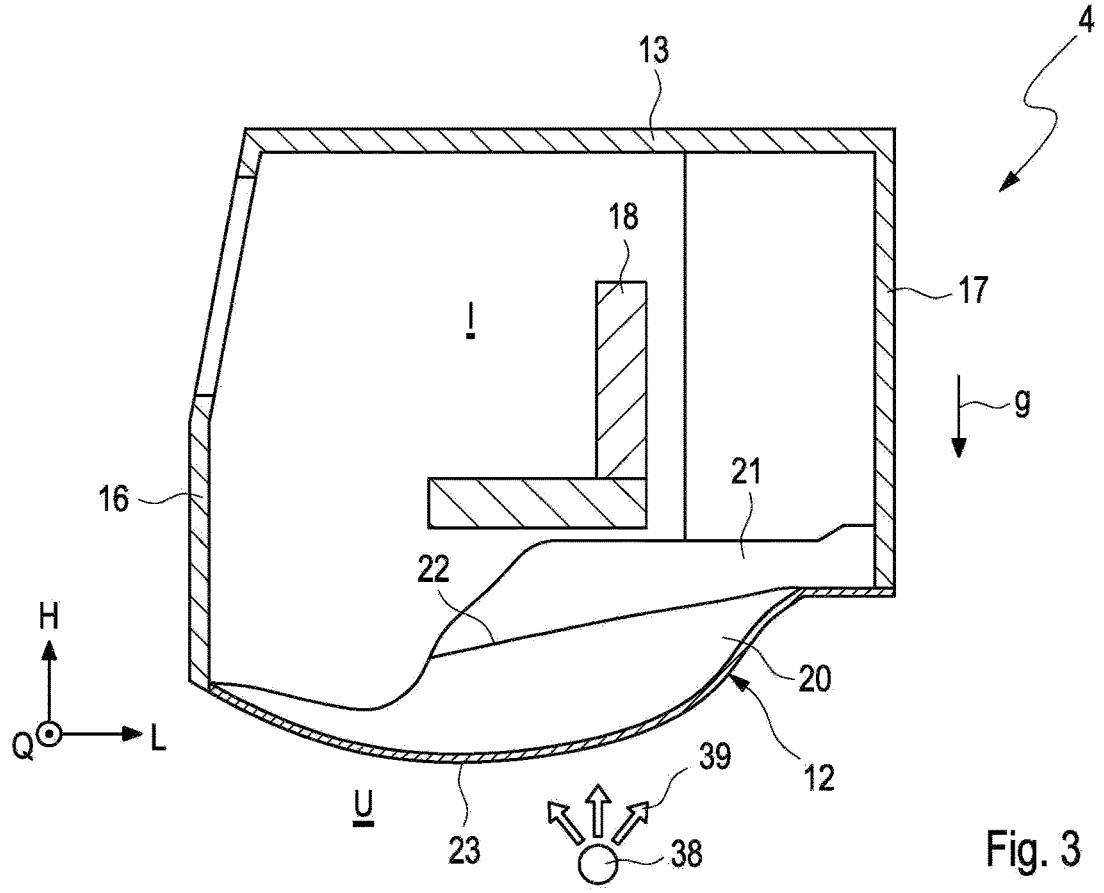
FIG. 3 shows a schematic cross-sectional view of the driver's cab according to the sectional line of FIG. 2.

FIG. 2 shows a schematic front view of an embodiment of a driver's cab 4 for the utility vehicle 1. FIG. 3 shows a schematic cross-sectional view of the driver's cab 4 according to the sectional line of FIG. 2. In the following, reference is made to FIGS. 2 and 3 simultaneously.

The previously mentioned coordinate system with the directions H, L, Q can also be assigned to the driver's cab 4. The driver's cab 4 comprises a mine-protected, in particular mine-protection-optimized, driver's cab floor 12, a ceiling 13 arranged opposite the driver's cab floor 12, two side walls 14, 15 arranged opposite each other, which can be provided with doors, a front wall 16 and a rear wall 17 arranged opposite the front wall 16. The front wall 16 can have a windshield.

The driver's cab floor 12, the ceiling 13, the side walls 14, 15, the front wall 16 as well as the rear wall 17 enclose the interior space I. Thereby, the interior space I can be accessible from the environment U by means of doors and/or hatches. Accommodated in the driver's cab 4, i.e. arranged in the interior space I, are a driver's seat or first seat 18 and a passenger's seat or second seat 19. The first and second seats 18, 19 are positioned adjacent to and spaced apart from each other as viewed in the cross direction Q.

Figure 4:
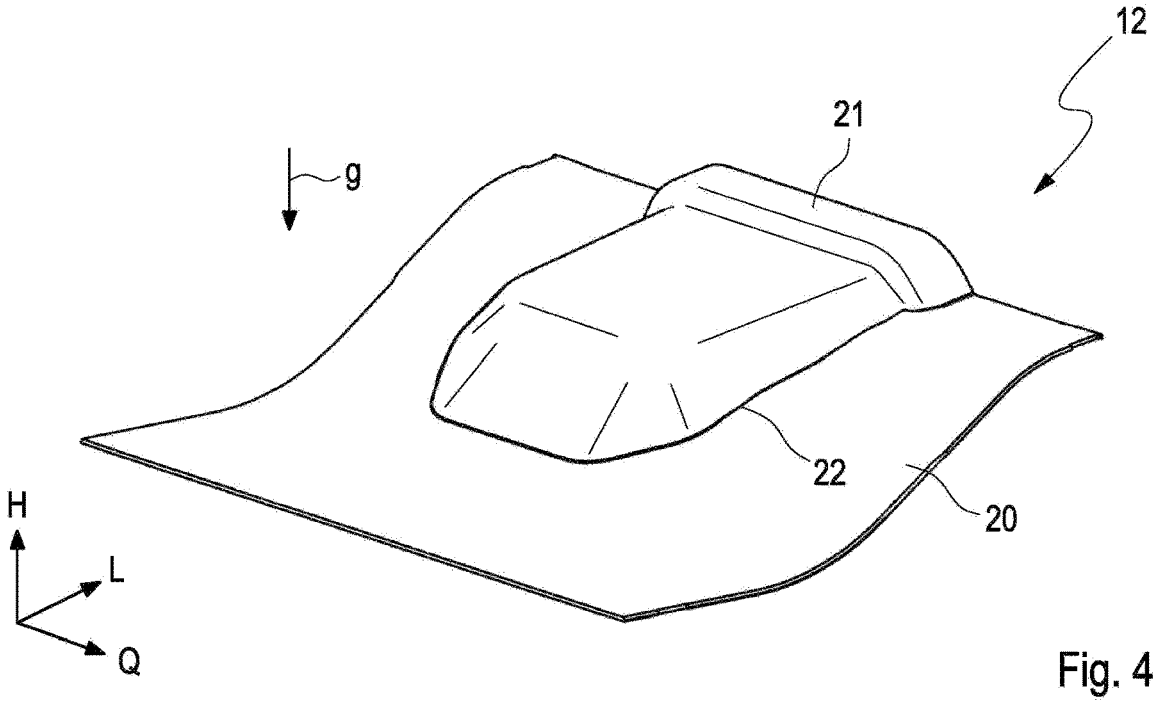
FIG. 4 shows a schematic perspective view of an embodiment of a driver's cab floor for the driver's cab according to FIG. 2.
Figure 5:
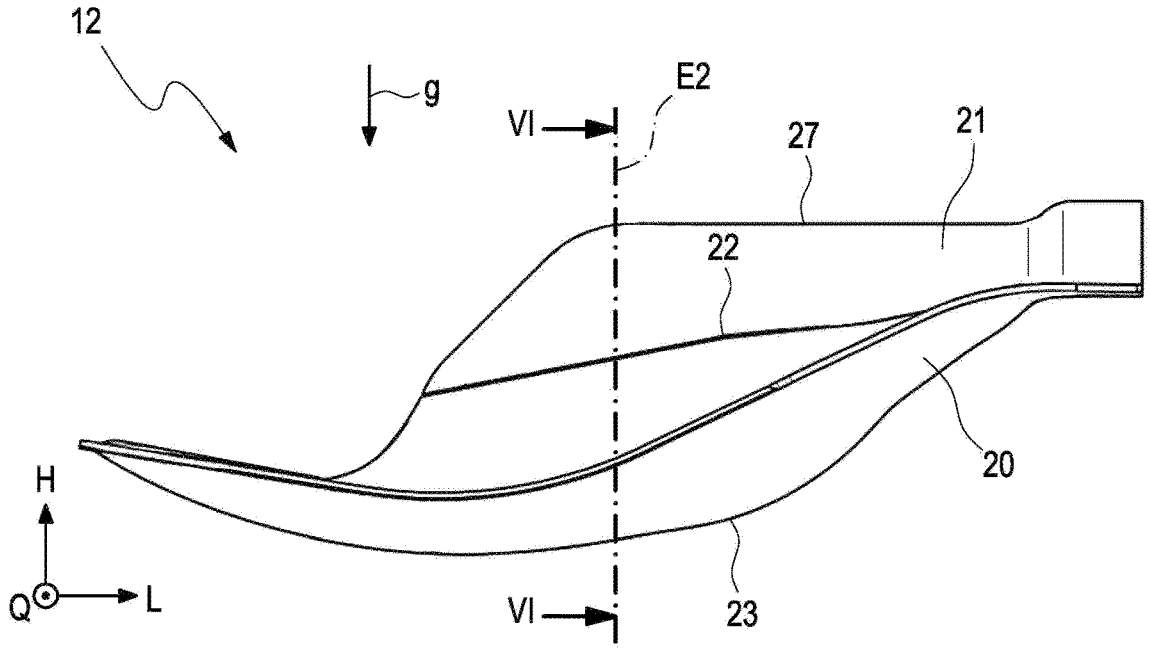
FIG. 5 shows a schematic side view of the driver's cab floor according to FIG. 4.
Figure 6:
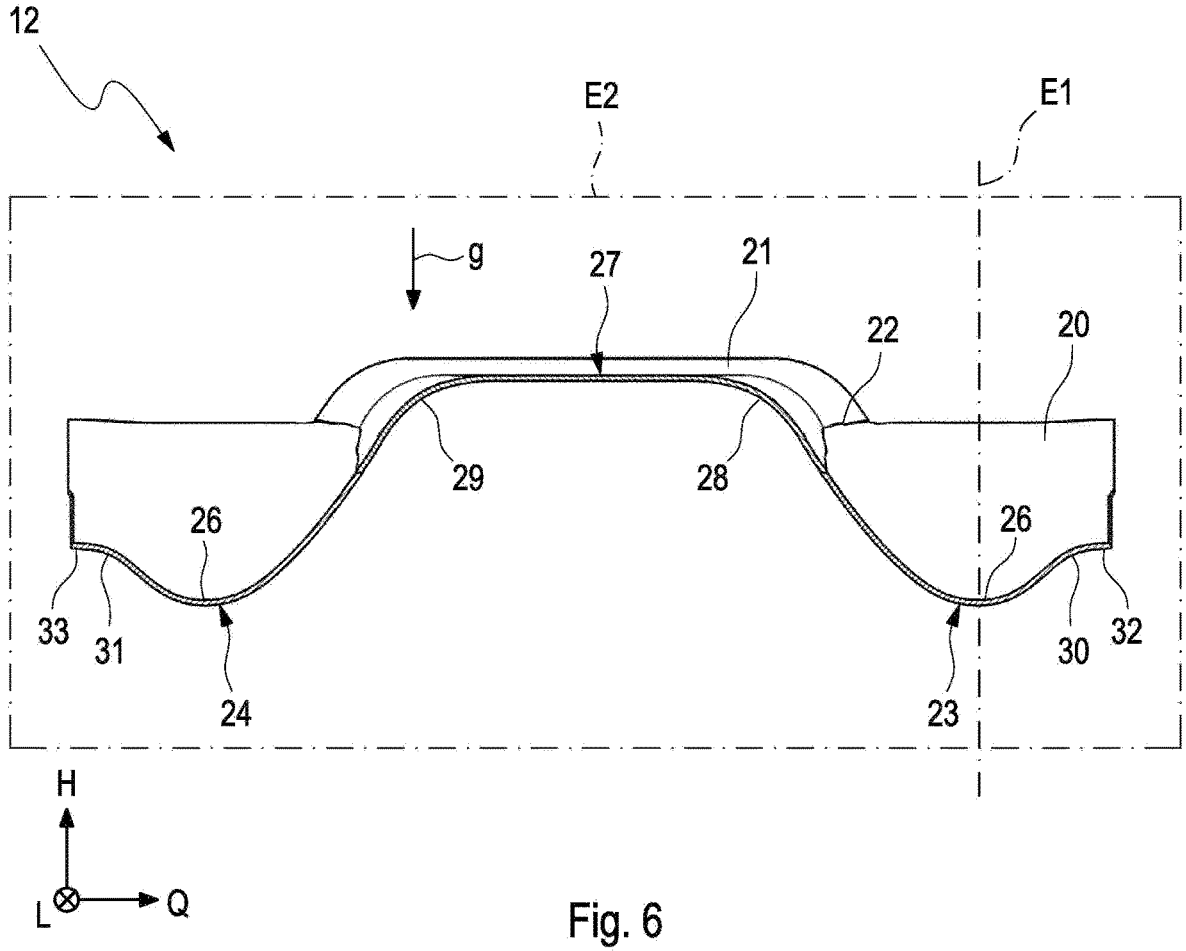
FIG. 6 shows a schematic cross-sectional view of the driver's cab floor according to the sectional line VI-VI of FIG. 5.
Figure 7:
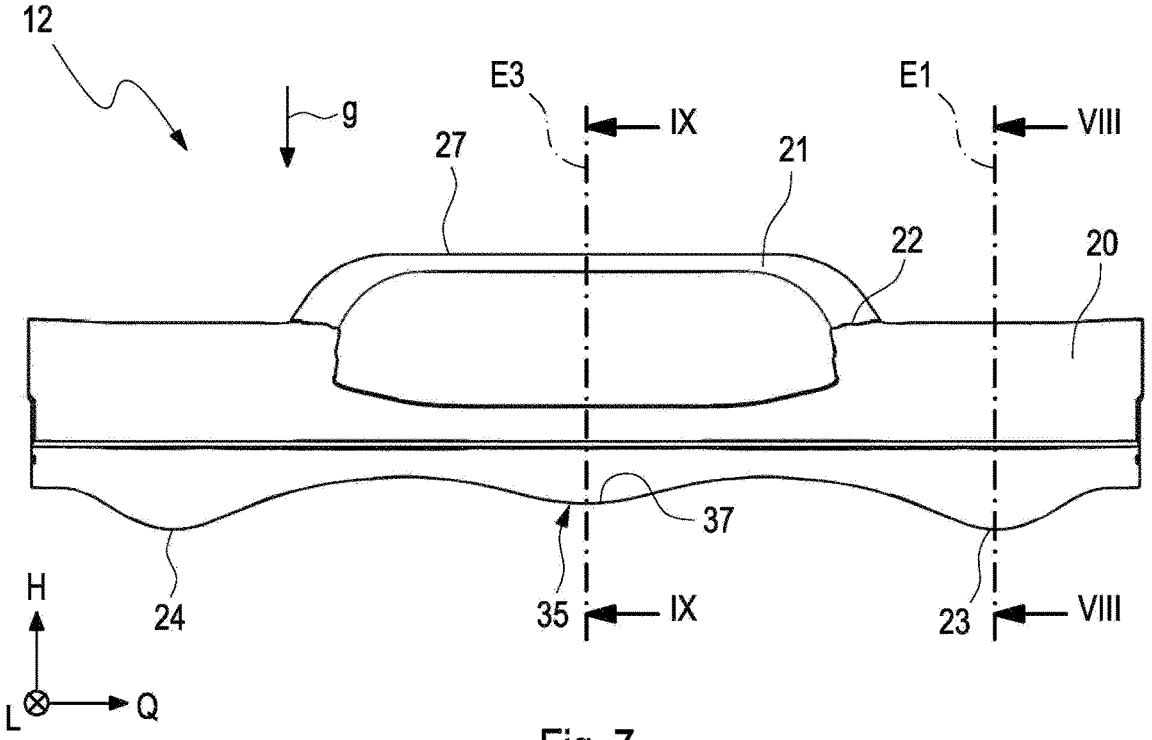
FIG. 7 shows a schematic front view of the driver's cab floor according to FIG. 4.
Figure 8:
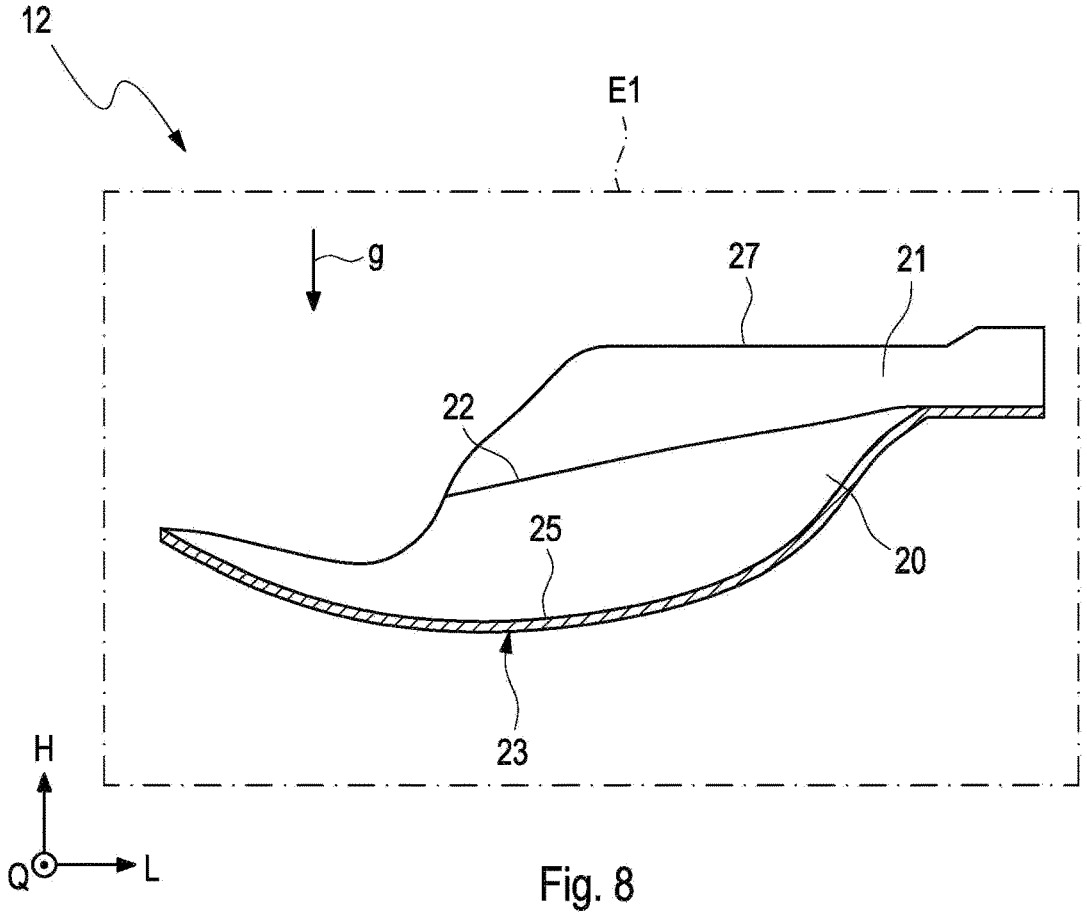
FIG. 8 shows a schematic cross-sectional view of the driver's cab floor according to the sectional line VIII-VIII of FIG. 7.
Figure 9:
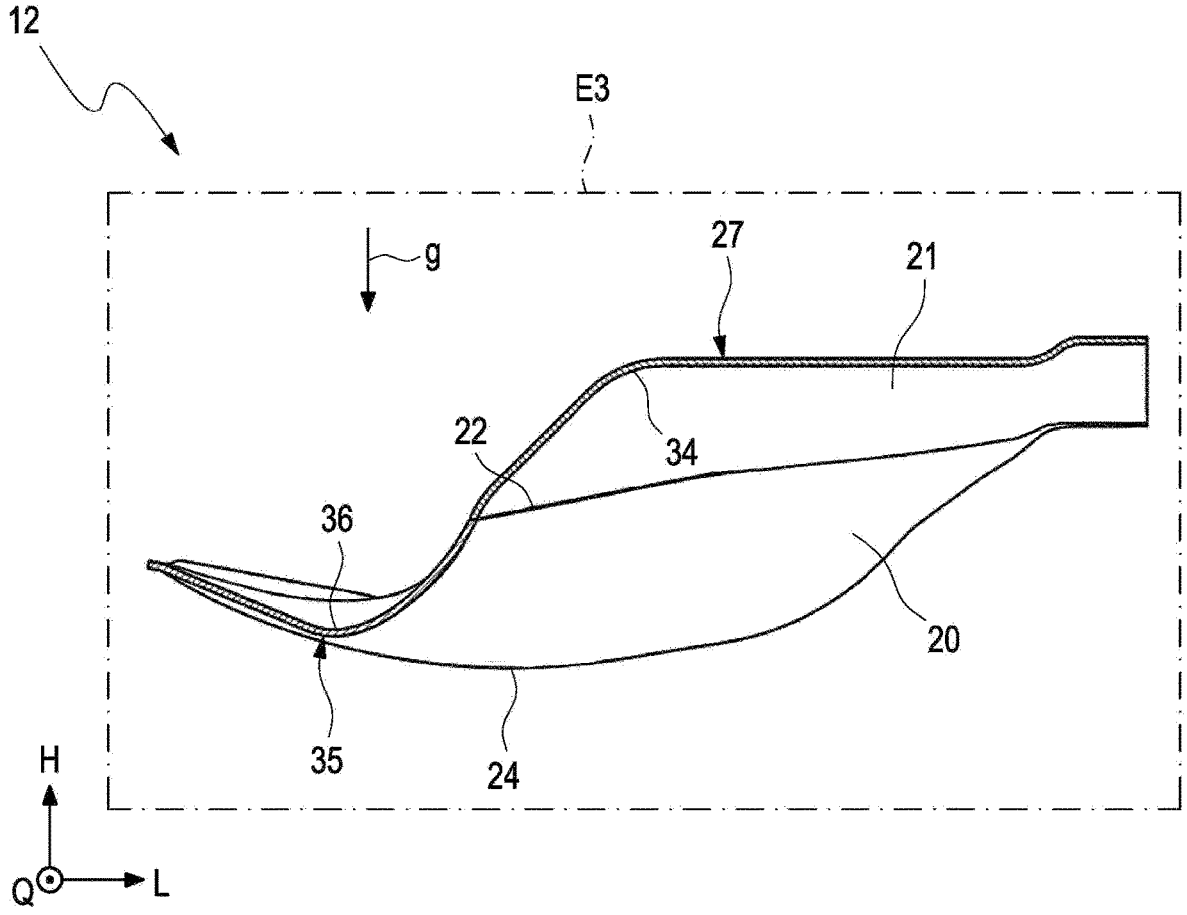
FIG. 9 shows another schematic cross-sectional view of the driver's cab floor according to the sectional line IX-IX of FIG. 7.

FIG. 4 shows a schematic perspective view of an embodiment of a driver's cab floor 12 for the driver's cab 4 as previously mentioned. FIG. 5 shows a schematic side view of the driver's cab floor 12. FIG. 6 shows a schematic cross-sectional view of the driver's cab floor 12 according to the sectional line VI-VI of FIG. 5. FIG. 7 shows a schematic front view of the driver's cab floor 12, FIG. 8 shows another schematic cross-sectional view of the driver's cab floor 12 according to the sectional line VIII-VIII of FIG. 7, and FIG. 9 shows another schematic cross-sectional view of the driver's cab floor 12 according to the sectional line IX-IX of FIG. 7. In the following, reference is made to FIGS. 4 to 9 simultaneously.

The driver's cab floor 12 includes a lower part 20 and an upper part 21. The lower part 20 and the upper part 21 are joined together at an interface 22. The interface 22 may be a weld. In other words, the driver's cab floor 12 is in two parts. Alternatively, the driver's cab floor 12 may be an integrally formed component. "Integrally" or "one-piece" means in the present context that the driver's cab floor 12 is formed from only one part and is not composed of different components. In particular, the driver's cab floor 12 may also be formed as one piece of material. "One-piece of material" means in the present case that the driver's cab floor 12 is made of the same material throughout.

Preferably, however, the driver's cab floor 12 is of two-part design and comprises the lower part 20 and the upper part 21 firmly connected thereto. The lower part 20 and the upper part 21 are each designed as integrally formed components, in particular as one-piece of material components. The lower part 20 and the upper part 21 are made of steel, in particular armored steel. However, other materials, such as aluminum alloys or fiber composites, can also be used for the driver's cab floor 12.

The driver's cab floor 12 is not flat, but has a three-dimensionally shaped geometry, in particular in the form of a free-form surface. A "free-form surface" in this context means any three-dimensionally shaped surface. A free-form surface can be described in particular with the aid of piecewise polynomial functions. In particular, free-form surfaces are three-dimensional, usually double-curved surfaces.

To produce the driver's cab floor 12, the lower part 20 and the upper part 21 are preheated as semi-finished products, in particular as blanks, for example in the form of armored steel plates, and inserted separately from one another into a corresponding mold and hot-formed. The lower part 20 and the upper part 21 can then be joined together at the interface 22. The two-part nature of the driver's cab floor 12 thus makes it easier to manufacture the driver's cab floor 12 while maintaining high degrees of forming. The "degree of forming" is a deformation parameter which can be used to record the permanent geometric change in a workpiece during the forming process.

As mentioned before, the coordinate system with the directions H, L. Q can be assigned to the driver's cab 4. Furthermore, the coordinate system with the directions H, L, Q can also be assigned to the driver's cab floor 12. In this case, the height direction H and the longitudinal direction L span a first sectional plane E1 (FIGS. 6, 7 and 8), which intersects the driver's cab floor 12 and the driver's cab 4, respectively. In this context, "spanning" means that the height direction H and the longitudinal direction L define the orientation of the first sectional plane E1 in space. The height direction H and the longitudinal direction L can lie in the first sectional plane E1 or run parallel to it.

Furthermore, a second sectional plane E2 (FIGS. 5 and 6) is assigned to the driver's cab floor 12 or the driver's cab 4. The second sectional plane E2 is defined by the height direction H and the cross direction Q. That is, the height direction H and the cross direction Q lie in the second sectional plane E2 or are arranged parallel thereto. The first sectional plane E1 and the second sectional plane E2 are positioned perpendicular to each other.

Any number of first sectional planes E1 may be provided, which, viewed along the cross direction Q, may be spaced apart from and parallel to each other. Furthermore, any number of second sectional planes E2 can also be provided, which, viewed along the longitudinal direction L, are arranged adjacent to and spaced apart from one another. In the following, however, only one first sectional plane E1 and one second sectional plane E2 are assumed in each case.

Furthermore, a third sectional plane E3 (FIGS. 7 and 9) is provided which is parallel to and spaced from the first sectional plane E1. That is, the third sectional plane E3 is also spanned by the height direction H and the longitudinal direction L, whereby the height direction H and the longitudinal direction L can either be placed in the third sectional plane E3 or are arranged parallel to it. The third sectional plane E3 is provided centrally on the driver's cab floor 12. The driver's cab floor 12 is constructed in mirror symmetry to the third sectional plane E3.

The driver's cab floor 12 has a first protrusion 23 formed thereon, which is curved away from the interior space I. That is, the first protrusion 23 curves into the environment U of the driver's cab 4. Preferably, a first protrusion 23 associated with the first seat 18 and a second protrusion 24 associated with the second seat 19 are provided. Viewed along the height direction H, the first seat 18 is arranged above the first protrusion 23. Accordingly, the second seat 19 is arranged above the second protrusion 24 when viewed along the height direction H. The first and second protrusions 23, 24 are preferably of identical construction. The first and second protrusions 23, 24 are placed in mirror symmetry with respect to the third sectional plane E3. The first and second protrusions 23, 24 may also be referred to as dents or bulges.

The first and second protrusions 23, 24 have a three-dimensional buckling-optimized geometry, so that the first and second protrusions 23, 24 have a high stiffness or structural strength. The first and second protrusions 23, 24 are egg-shaped or ovoid-shaped at least in sections. As used herein, the terms "egg-shaped" or "ovoid-shaped" refer to a three-dimensional roundish figure that broadly resembles the profile of a bird's egg. In particular, the egg-shaped geometry can be created by rotating an oval about an axis of symmetry. In contrast to an ellipse, however, the oval has only one axis of symmetry, with respect to which the oval has a mirror symmetrical structure. The geometry of the first and second protrusions 23, 24 can also be called ovoid. The first and second protrusions 23, 24 are formed on the lower part 20 of the driver's cab floor 12.

Since the first and second protrusions 23, 24 are identically constructed and arranged in mirror symmetry to the third sectional plane E3, only the first protrusion 23 will be discussed below. However, all explanations concerning the first protrusion 23 are applicable to the second protrusion 24.

The first sectional plane E1 runs centrally through the first protrusion 23 with respect to the cross direction Q. The first protrusion 23 can be at least partially mirror-symmetrical with respect to the first sectional plane E1. The first protrusion 23 comprises a first contour 25 (FIG. 8), which is arranged in the first sectional plane E1. The first contour 25 may be an inner contour of the first protrusion 23. Alternatively, the first contour 25 may be an outer contour of the first protrusion 23. The inner contour and outer contour differ from each other only by a wall thickness of the first protrusion 23. In the present context, the term "contour" is to be understood as a curve which, for a viewer looking perpendicularly to the first sectional plane E1, delimits the first protrusion 23 from its surroundings. The term "contour" can be replaced by the terms "outline" or "curve".

The first contour 25 is convexly curved. That is, the first protrusion 23 curves out of the interior space I into the environment U. The first contour 25 is curved to the left. The first contour 25 may be composed of different radii, ellipse sections, oval sections, curve sections, straight line sections or the like. However, in any case, the first contour 25 has an arcuate curvature or exhibits an arcuate curvature at least in sections.

Particularly preferably, however, the first contour 25 is continuously curved, in particular continuously curved in the shape of an arc. "Continuously curved" means in the present case that the first contour 25 has no straight line sections. In the event that the first contour 25 is continuously curved, the first contour 25 is preferably exclusively composed of different curved geometries, such as, for example, circular sections, arcs, radii, elliptical sections, oval sections and/or curved sections. In particular, an "arc" may be understood to mean an arc of a circle, i.e., a circular section. The first contour 25 may also be a circular section, an arc, a radius, an ellipse section, an oval section, or a curve section. In this case, the first contour 25 is not composed of different geometries.

The first contour 25 has a convex curvature. In the present context, the term "curvature" is to be understood as the local deviation of the first contour 25 from a straight line. The term "curvature" can also be replaced by the term "degree of curvature", which quantitatively indicates for each point of the first contour 25 how strong this local deviation is from a straight line. The greater the curvature, the more tightly the first contour 25 is curved.

The first contour 25 defines the first protrusion 23 in the first sectional plane E1. That is, the first contour 25 indicates a two-dimensional geometry of the first protrusion 23 that results in the first sectional plane E1 when the first sectional plane E1 intersects the first protrusion 23. In case a plurality of different first sectional planes E1 are considered, which—as mentioned before—are arranged parallel to each other, a plurality of first contours 25, which differ from each other in their two-dimensional geometry, results in these additional first sectional planes E1. The first sectional plane E1 shown in FIG. 8 intersects the first protrusion 23 in its largest deflection away from the interior space I or into the environment U, respectively.

The first protrusion 23 is further associated with a second contour 26 (FIG. 6) defining the first protrusion 23, which is arranged in the second sectional plane E2. The second contour 26 can also be an inner contour or an outer contour of the first protrusion 23. The inner contour and outer contour differ from each other only by the wall thickness of the first protrusion 23. Again, in the case where a plurality of different second sectional planes E2 are considered, which—as previously mentioned—are arranged parallel to each other, a plurality of second contours 26 are obtained in these additional second sectional planes E2, which differ from each other in their two-dimensional geometry. The second sectional plane E2 shown in FIG. 6 intersects the first protrusion 23 in its largest deflection away from the interior space I or into the environment U, respectively.

Since the first sectional plane E1 and the second sectional plane E2 are arranged perpendicular to each other, the first contour 25 and the second contour 26 are also positioned perpendicular to each other. This results in a double-curved surface that describes the first protrusion 23. The first and second contours 25, 26 thus form the three-dimensional egg-shaped geometry of the first protrusion 23.

The second contour 26 can be circularly curved, at least in sections. Like the first contour 25, the second contour 26 can be composed of different radii, elliptical sections, oval sections, curved sections, straight sections or the like. However, in any case, the second contour 26 has an arcuate curvature or exhibits an arcuate curvature at least in sections. The second contour 26 exhibits a convex curvature. The second contour 26 is preferably curved to the left. The first contour 25 differs from the second contour 26 in its curvature. In particular, the second contour 26 is more curved than the first contour 25.

Particularly preferably, however, the second contour 26 is continuously curved, in particular continuously curved in the shape of an arc. "Continuously curved" means in the present case that the second contour 26 has no straight line sections. In the case where the second contour 26 is continuously curved, the second contour 26 is preferably exclusively composed of different curved geometries, such as, for example, circular sections, arcs, radii, elliptical sections, oval sections and/or curved sections. In particular, an "arc" may be understood to mean a circular arc, i.e., a circular section. The second contour 26 may also be a circular section, an arc, a radius, an ellipse section, an oval section, or a curve section. In this case, the second contour 26 is not composed of different geometries.

Between the first protrusion 23 and the second protrusion 24, a dome section 27 is formed on the driver's cab floor 12, in particular on the upper part 21 of the driver's cab floor 12. The dome section 27 projects inwardly into the interior space I of the driver's cab 4. For example, the dome section 27 can receive a transmission tunnel.

As shown in FIG. 6, the second contour 26 of the respective first and second protrusion 23, 24 merges into the dome section 27 on both sides of the dome section 27 with a respective radius 28, 29. The radii 28, 29 have a curvature direction opposite to that of the second contours 26 of the two first and second protrusions 23, 24. Furthermore, the second contour 26 of the two first and second protrusions 23, 24 merges via radii 30, 31 into an edge section 32, 33 of the driver's cab floor 12 adjoining the first and second protrusions 23, 24 on both sides. The radii 30, 31 are curved in the opposite direction to the respective second contour 26.

A third contour 34 defining the dome section 27 (FIG. 9) is positioned in the third sectional plane E3. The third contour 34 can also be an inner contour or an outer contour, which differ from each other only by a wall thickness of the dome section 27. The third contour 34 may be composed of different radii, ellipse sections, oval sections, curve sections, straight line sections or the like. However, in any case, the third contour 34 has an arcuate curvature or exhibits an arcuate curvature at least in sections.

Furthermore, a third protrusion 35 is provided centrally between the first and second protrusions 23, 24. The third protrusion 35 is curved less far out of the interior space I than the first and second protrusions 23, 24. The third protrusion 35 is defined with the aid of a fourth contour 36 (FIG. 9) placed in the third sectional plane E3 and a fifth contour 37 (FIG. 7) oriented perpendicular to the fourth contour 36. The fifth contour 37 is located in a sectional plane parallel to the second sectional plane E2 (not shown). The fourth and fifth contours 36, 37 can also be inner contours or outer contours.

The fourth and fifth contours 36, 37 can each be composed of different radii, ellipse sections, oval sections, curve sections, straight line sections or the like. However, both the fourth contour 36 and the fifth contour 37 are curved in an arcuate manner at least in sections or exhibit an arcuate curvature in each case. In this regard, the fourth contour 36 merges with the third contour 34 of the dome section 27. The fourth contour 36 and the third contour 34 are curved in opposite directions.

The functionality of the driver's cab floor 12 is explained below. In the event of the driver's cab 4 being struck by an explosive device 38 (FIGS. 2 and 3), for example in the form of a mine or an IED, the respective first and second protrusion 23, 24 protects the driver or passenger from a blast or blast wave 39 from the explosive device 38. The protection in this case is brought about by the previously explained three-dimensional geometry of the first and second protrusions 23, 24. Due to their three-dimensional geometry, the first and second protrusions 23, 24 are optimized for buckling and have a high stiffness or structural rigidity. This prevents the driver's cab floor 12, in particular under the first and second seats 18, 19, from deforming into the interior space I, which could lead to injury to the occupants.

Due to the partially egg-shaped geometry of the respective first and second protrusion 23, 24, a high structural stiffness can be realized without additional material in the form of bulges, ribs and/or stiffening elements. The geometry of the first and second protrusions 23, 24 has a high inherent stiffness due to the egg-shaped form. At the same time, a low wall thickness can be achieved in the driver's cab floor 12. This results in a weight saving.

Additional weight due to thickening, ribs and/or stiffening elements, additional machining steps and the associated additional costs, as well as deteriorated material properties due to heat input when welding on additional material can thus be avoided. The driver's cab floor 12 can fully achieve the required safety level in the event of blasting with the aid of the explosive device 38 under the given geometric boundary conditions.

Although the present invention has been described with reference to examples of embodiments, it can be modified in a variety of ways.

LIST OF REFERENCE CHARACTERS

1 Utility vehicle
2 Chassis
3 Chassis frame
4 Driver's cab
5 Axle
6 Axle
7 Axle
8 Wheel
9 Wheel
10 Wheel
11 Superstructure
12 Driver's cab floor
13 Ceiling
14 Side wall
15 Side wall
16 Front wall
17 Rear wall
18 Seat
19 Seat
20 Lower part
21 Upper part
22 Interface
23 Protrusion
24 Protrusion
25 Contour
26 Contour
27 Dome section
28 Radius
29 Radius
30 Radius

31 Radius
32 Edge section
33 Edge section
34 Contour
35 Protrusion
36 Contour
37 Contour
38 Explosive device
39 Blast wave
E1 Sectional plane
E2 Sectional plane
E3 Sectional plane
g Direction of gravity
I Interior space
H Height direction
L Longitudinal direction
Q Cross direction
U Environment

The invention claimed is:

1. Driver's cab for a utility vehicle, in particular for a military utility vehicle, comprising an interior space enclosed by the driver's cab, a driver's cab floor, and a protrusion formed on the driver's cab floor, wherein the protrusion is curved away from the interior space such that the protrusion extends away from the interior space and extends into an environment of the driver's cab, wherein the protrusion comprises a first contour defining the protrusion in a first sectional plane intersecting the driver's cab floor, wherein the first contour is curved in an arcuate manner at least in sections, wherein the protrusion comprises a second contour defining the protrusion in a second sectional plane intersecting the driver's cab floor, wherein the second contour is curved in an arcuate manner at least in sections, and wherein the first sectional plane and the second sectional plane are positioned perpendicular to each other, wherein a first protrusion and a second protrusion are formed on the driver's cab floor, wherein the protrusions are arranged at a distance from each other, wherein a third protrusion is formed on the driver's cab floor, wherein the third protrusion is curved away from the interior space, and wherein the third protrusion is arranged between the first protrusion and the second protrusion.

2. Driver's cab according to claim 1, characterized in that a height direction of the driver's cab and a longitudinal direction of the driver's cab span the first sectional plane, wherein the height direction and a cross direction of the driver's cab span the second sectional plane, and wherein the height direction, the longitudinal direction and the cross direction are positioned perpendicular to each other.

3. Driver's cab according to claim 2, characterized in that the first sectional plane and the second sectional plane each intersect the protrusion centrally.

4. Driver's cab according to claim 1, characterized in that the first contour is continuously curved, and/or wherein the second contour is continuously curved.

5. Driver's cab according to claim 1, characterized in that the protrusion is at least partially egg-shaped.

6. Driver's cab according to claim 1, characterized in that the first contour differs in its curvature from the second contour.

7. Driver's cab according to claim 1, characterized in that the second contour is more curved than the first contour.

8. Driver's cab according to claim 1, characterized in that a dome section projecting into the interior space is formed on the driver's cab floor and is arranged between the first protrusion and the second protrusion.

9. Driver's cab according to claim 8, characterized in that the dome section comprises a radius defining the dome section in the second sectional plane, wherein the radius is curved in the opposite direction to the second contour.

10. Driver's cab according to claim 8, characterized in that the dome section comprises a third contour defining the dome section in a third sectional plane parallel to the first sectional plane and arranged at a distance therefrom, wherein the third contour is curved at in an arcuate manner at least in sections.

11. Driver's cab according to claim 1, characterized in that the driver's cab floor comprises a lower part, on which the protrusion is formed, and an upper part connected to the lower part at an interface.

12. Driver's cab according to claim 11, characterized in that the lower part and/or the upper part are each formed integrally, in particular as one piece of material.

13. Utility vehicle, in particular military utility vehicle, comprising a driver's cab according to claim 1.

* * * * *